US011878769B2

(12) United States Patent
Itai

(10) Patent No.: US 11,878,769 B2
(45) Date of Patent: Jan. 23, 2024

(54) AQUATIC MOVING BODY

(71) Applicant: HONDA MOTOR CO., LTD., Tokyo (JP)

(72) Inventor: Ryosuke Itai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 151 days.

(21) Appl. No.: 17/695,629

(22) Filed: Mar. 15, 2022

(65) Prior Publication Data

US 2022/0297799 A1 Sep. 22, 2022

(30) Foreign Application Priority Data

Mar. 18, 2021 (JP) ..... 2021-045140

(51) Int. Cl.
*B63B 1/24* (2020.01)
*B63B 1/26* (2006.01)
*B63B 1/28* (2006.01)

(52) U.S. Cl.
CPC ..... *B63B 1/246* (2013.01); *B63B 1/248* (2013.01); *B63B 1/26* (2013.01); *B63B 1/285* (2013.01)

(58) Field of Classification Search
CPC .... B63B 1/00; B63B 1/16; B63B 1/18; B63B 2001/183; B63B 1/20; B63B 1/22; B63B 1/24; B63B 1/242; B63B 1/246; B63B 1/248; B63B 1/26; B63B 1/28; B63B 1/285; B63B 1/286
USPC ..... 114/271, 274, 275, 278, 280
See application file for complete search history.

(56) References Cited

U.S. PATENT DOCUMENTS 2,749,870 A * 6/1956 Vavra ..... B63B 1/246 114/282
3,027,862 A * 4/1962 Votre ..... B63B 1/30 440/12.54
3,031,999 A * 5/1962 Bader ..... B63B 1/285 114/280
5,311,832 A * 5/1994 Payne ..... B63B 1/285 114/274
5,653,189 A * 8/1997 Payne ..... B63B 1/246 114/274
10,759,496 B2 * 9/2020 Van Oossanen ..... B63B 1/04

FOREIGN PATENT DOCUMENTS

JP 3172459 U 12/2011

* cited by examiner

*Primary Examiner* — Daniel V Venne
(74) *Attorney, Agent, or Firm* — WHDA, LLP

(57) ABSTRACT

The present invention provides an aquatic moving body configured to move in a state where a main body portion is floated above a water surface, comprising: a first hydrofoil and a second hydrofoil disposed along a left-and-right direction of the aquatic moving body and provided in the main body portion so as to be able to change elevation angles independently of each other; a first propulsion unit provided at an end portion of the first hydrofoil and configured to generate a propulsive force; and a second propulsion unit provided at an end portion of the second hydrofoil and configured to generate a propulsive force, wherein a first partition wall is provided between the first hydrofoil and the first propulsion unit, and a second partition wall is provided between the second hydrofoil and the second propulsion unit.

13 Claims, 5 Drawing Sheets

| POSTURE OF CONTROL TARGET | | OUTPUT RELATIONSHIP OF EACH PROPULSOR |
|---|---|---|
| ROLLING | + (LEFT UP) | $F_{2U} - F_{2L} < F_{1U} - F_{1L}$ |
| | — (LEFT DOWN) | $F_{2U} - F_{2L} > F_{1U} - F_{1L}$ |
| PITCHING | + (FRONT UP) | $F_{1U} + F_{2U} < F_{1L} + F_{2L}$ |
| | — (FRONT DOWN) | $F_{1U} + F_{2U} > F_{1L} + F_{2L}$ |
| YAWING | + (RIGHT ROTATION) | $F_{2U} + F_{2L} > F_{1U} + F_{1L}$ |
| | — (LEFT ROTATION) | $F_{2U} + F_{2L} < F_{1U} + F_{1L}$ |

AQUATIC MOVING BODY

CROSS-REFERENCE TO RELATED APPLICATION(S)

This application claims priority to and the benefit of Japanese Patent Application No. 2021-045140 filed on Mar. 18, 2021, the entire disclosure of which is incorporated herein by reference.

BACKGROUND OF THE INVENTION

Field of the Invention

The present invention relates to an aquatic moving body.

Description of the Related Art

Japanese Utility Model Registration No. 3172459 discloses a ship that navigates in a state where a hull is floated above a water surface so as to reduce swinging of the hull due to influence of waves. The ship disclosed in Japanese Utility Model Registration No. 3172459 has a hydrofoil fixed to each of a front portion and a rear portion of the hull, and a propeller fixed to a side portion of the hydrofoil at the rear portion, and can raise and lower the hull in an up-and-down direction by controlling rotational driving of the propeller. In addition, the ship has a rudder behind the propulsor, and the rudder changes a direction of water flow generated by the propeller, allowing the ship to change its advancing direction.

In such a ship (aquatic moving body) that navigates in the state where the hull (main body portion) is floated above the water surface, it is desirable to efficiently generate lift for floating the hull above the water surface by using hydrofoils.

SUMMARY OF THE INVENTION

The present invention provides an aquatic moving body capable of efficiently generating lift for floating a main body portion above a water surface, for example.

According to one aspect of the present invention, there is provided an aquatic moving body configured to move in a state where a main body portion is floated above a water surface, comprising: a first hydrofoil and a second hydrofoil disposed along a left-and-right direction of the aquatic moving body and provided in the main body portion so as to be able to change elevation angles independently of each other; a first propulsion unit provided at an end portion of the first hydrofoil and configured to generate a propulsive force; and a second propulsion unit provided at an end portion of the second hydrofoil and configured to generate a propulsive force, wherein a first partition wall for separating a water flow around the first hydrofoil and a water flow generated by the first propulsion unit is provided between the first hydrofoil and the first propulsion unit, and wherein a second partition wall for separating a water flow around the second hydrofoil and a water flow generated by the second propulsion unit is provided between the second hydrofoil and the second propulsion unit.

Further features of the present invention will become apparent from the following description of exemplary embodiments with reference to the attached drawings.

DESCRIPTION OF THE EMBODIMENTS

Figure 1:
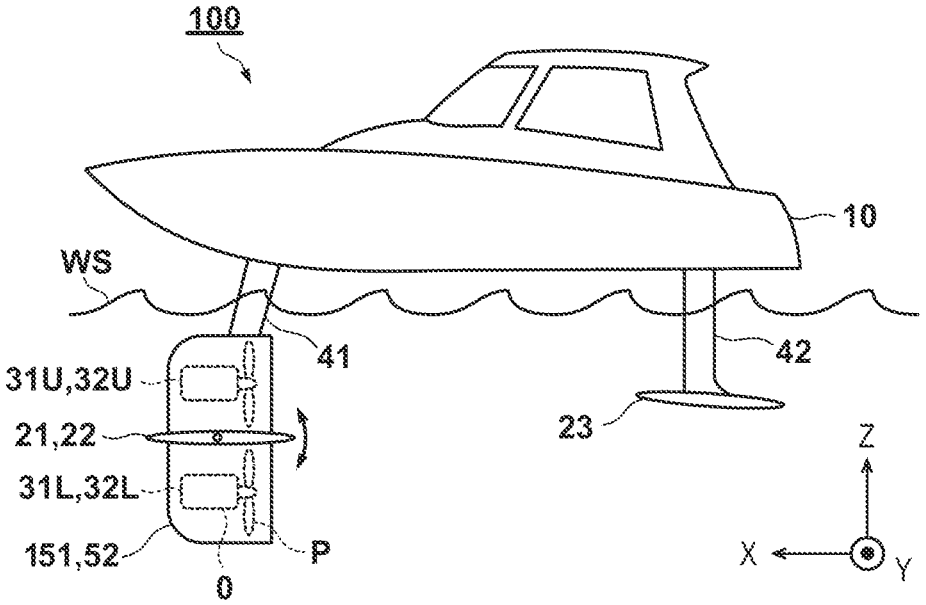
FIG. 1 is a schematic diagram showing an aquatic moving body.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

First Embodiment

Figure 2:
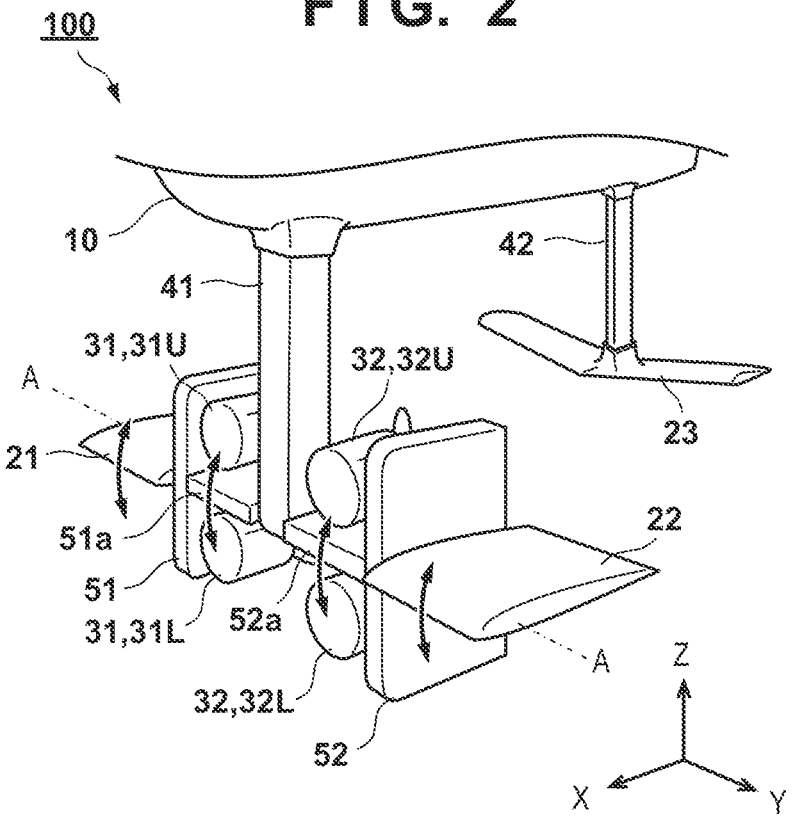
FIG. 2 is a diagram showing the aquatic moving body according to a first embodiment as viewed obliquely from the front.
Figure 3:
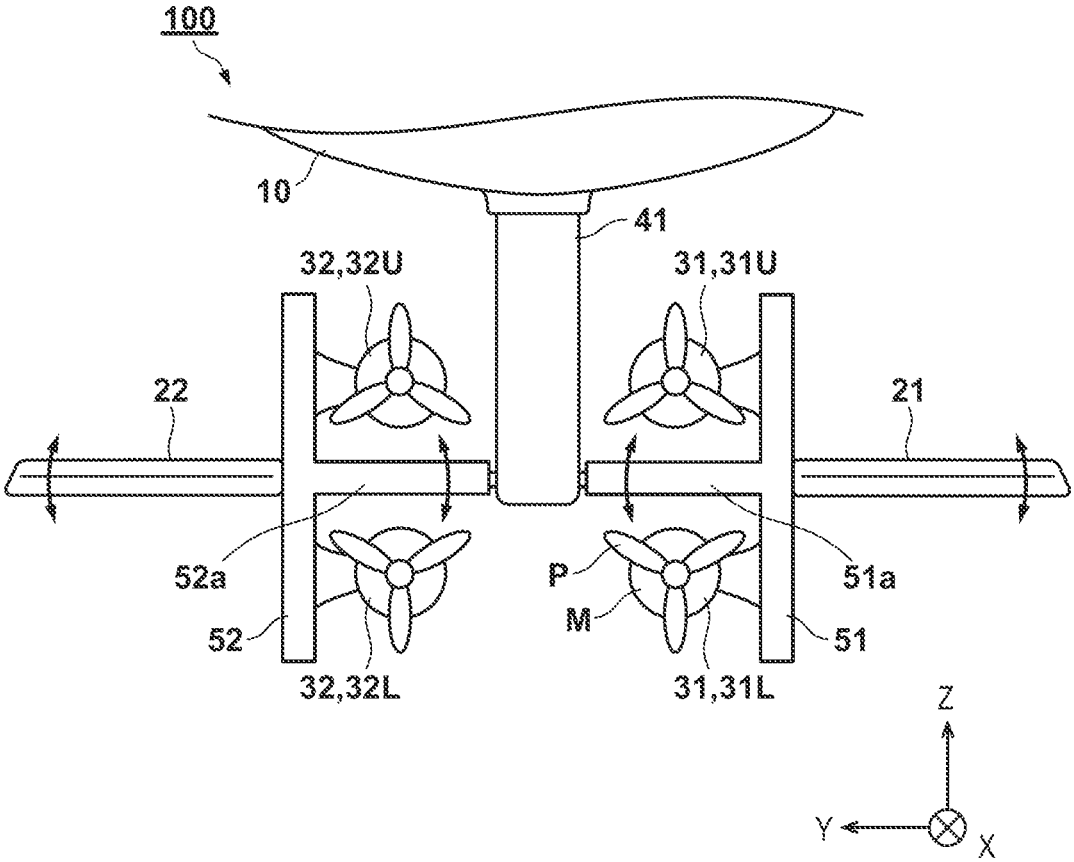
FIG. 3 is a rear view of a first hydrofoil and a second hydrofoil, and a peripheral configuration thereof in the aquatic moving body according to the first embodiment.

An aquatic moving body 100 of a first embodiment according to the present invention will be described with reference to FIGS. 1 to 3. FIG. 1 is a schematic diagram showing the aquatic moving body 100 of the first embodiment and is a side view of the aquatic moving body 100. FIG. 2 is a diagram showing the aquatic moving body 100 according to the first embodiment as viewed obliquely from the front and the upper side of a hull 10 is omitted. FIG. 3 is a rear view of a first hydrofoil 21 and a second hydrofoil 22, and a peripheral configuration thereof according to the first embodiment. Arrows X, Y, and Z in the drawing indicate a front-and-rear direction, a left-and-right direction (width direction), and an up-and-down direction of the aquatic moving body 100, respectively, and a +X direction is an advancing direction (forward direction) of the aquatic moving body 100.

The aquatic moving body 100 of the present embodiment is a ship capable of moving in a state where the hull 10 (main body portion) on which an occupant and a cargo are boarded is floated above a water surface WS. With such a configuration, it is possible to reduce swinging of the hull 10 due to influence of waves or the like. Here, in the present embodiment, a ship will be described as an example of the aquatic moving body 100, but the configuration of the aquatic moving body 100 of the present embodiment can also be applied to a small board for one person, a surfboard, or the like. For example, the aquatic moving body 100 may be configured such that an operator can sit on the main body portion, or may be configured such that an operator rides on the main body portion in another posture such as standing or lying face down.

The aquatic moving body 100 of the present embodiment includes a first hydrofoil 21 and a second hydrofoil 22. The first hydrofoil 21 and the second hydrofoil 22 are provided at a front portion of the hull 10 below the hull 10, and are supported by a first support member 41 attached to a lower portion (lower surface) of the hull 10. In addition, the first hydrofoil 21 and the second hydrofoil 22 are arranged to be aligned along the left-and-right direction (Y direction), and are configured to be able to change elevation angles independently of each other. In the present embodiment, the first hydrofoil 21 is disposed on the right side (−Y direction side) of the first support member 41 below the hull 10, and the second hydrofoil 22 is disposed on the left side (+Y direction side) of the first support member 41 below the hull 10. That is, the first hydrofoil 21 and the second hydrofoil 22 are disposed so as to sandwich the first support member 41 in the left-and-right direction. The first hydrofoil 21 and the second hydrofoil 22 are supported by the first support member 41 so as to be pivotable independently of each other around a pivot axis A-A parallel to the left-and-right direction within a predetermined angle range (that is, so as to be able to change an angle ωY around the axis independently of each other).

A first propulsion unit 31 that generates a propulsive force is provided at an end portion of the first hydrofoil 21. In the present embodiment, the first propulsion unit 31 is disposed between the first hydrofoil 21 and the first support member 41 in the left-and-right direction, that is, at the end portion of the first hydrofoil 21 on a side of the second hydrofoil 22. In addition, the first propulsion unit 31 may include a first upper propulsor 31U disposed above the first hydrofoil 21 in the up-and-down direction and a first lower propulsor 31L disposed below the first hydrofoil 21 in the up-and-down direction. It may be understood that the first upper propulsor 31U is disposed above the pivot axis A-A of the first hydrofoil 21 in the up-and-down direction and the first lower propulsor 31L is disposed below the pivot axis A-A of the first hydrofoil 21 in the up-and-down direction. Each of the first upper propulsor 31U and the first lower propulsor 31L is, for example, an electric propulsor having a motor M and a propeller P attached to a rotation shaft thereof, and can change the propulsive force by changing a rotational speed of the propeller P according to electric power supplied to the motor M.

A first partition wall 51 for separating (isolating) a water flow around the first hydrofoil 21 and a water flow generated by the first propulsion unit 31 is provided between the first hydrofoil 21 and the first propulsion unit 31 (first upper propulsor 31U, first lower propulsor 31L) in the left-and-right direction. By providing the first partition wall 51, the first hydrofoil 21 is less likely to be affected by the water flow generated by the first propulsion unit 31, so that lift can be efficiently generated. In the present embodiment, the first partition wall 51 is connected to the first hydrofoil 21 and is configured to be pivotable together with the first hydrofoil 21. The first partition wall 51 may be configured to have an upper end positioned above the first upper propulsor 31U and a lower end positioned below the first lower propulsor 31L in the up-and-down direction. The first propulsion unit 31 (first upper propulsor 31U, first lower propulsor 31L) is connected to the first partition wall 51, and the first hydrofoil 21 is pivotably supported by the first support member 41 via a first extending member 51*a* extended along the pivot axis A-A of the first hydrofoil. The first extending member 51*a* is a member that connects the first hydrofoil 21 and the first support member 41, and can be disposed between the first upper propulsor 31U and the first lower propulsor 31L in the up-and-down direction. In the present embodiment, the first extending member 51*a* is formed in a plate shape, but preferably has a shape that does not affect the water flow generated by the first hydrofoil 21, and may be formed in another shape such as a cylindrical shape or a columnar shape.

Figure 4:
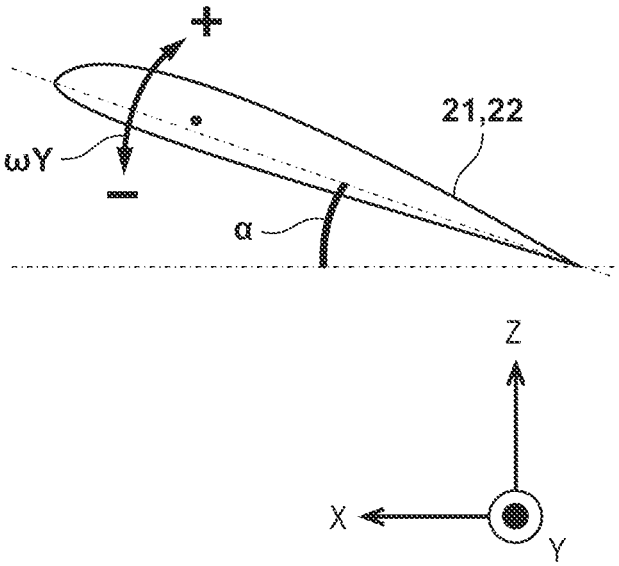
FIG. 4 is a diagram for explaining a relationship between an angle $\omega Y$ of the hydrofoil and an elevation angle $\alpha$.

In the first hydrofoil 21 having the first propulsion unit 31 described above, the elevation angle (angle ωY about the axis parallel to the left-and-right direction) may passively change according to an output difference (propulsive force difference) between the first upper propulsor 31U and the first lower propulsor 31L. As an example, by increasing the output (propulsive force) of the first lower propulsor 31L more than the output (propulsive force) of the first upper propulsor 31U, the angle ωY of the first hydrofoil 21 can be changed so as to increase the elevation angle α. In contrast, by decreasing the output (propulsive force) of the first lower propulsor 31L less than the output (propulsive force) of the first upper propulsor 31U, the angle ωY of the first hydrofoil 21 can be changed so as to decrease the elevation angle α. A relationship between the angle ωY of the hydrofoils (first hydrofoil 21, second hydrofoil 22) and the elevation angle α is as shown in FIG. 4.

Similarly, a second propulsion unit 32 that generates a propulsive force is provided at an end portion of the second hydrofoil 22. In the present embodiment, the second propulsion unit 32 is disposed between the second hydrofoil 22 and the first support member 41 in the left-and-right direction, that is, at the end portion of the second hydrofoil 22 on a side of the first hydrofoil 21. In addition, the second propulsion unit 32 may include a second upper propulsor 32U disposed above the second hydrofoil 22 in the up-and-down direction and a second lower propulsor 32L disposed below the second hydrofoil 22 in the up-and-down direction. It may be understood that the second upper propulsor 32U is disposed above the pivot axis A-A of the second hydrofoil 22 in the up-and-down direction and the second lower propulsor 32L is disposed below the pivot axis A-A of the second hydrofoil 22 in the up-and-down direction. Each of the second upper propulsor 32U and the second lower propulsor 32L is, for example, an electric propulsor having a motor M and a propeller P attached to a rotation shaft thereof, and can change the propulsive force by changing a rotational speed of the propeller P according to electric power supplied to the motor M.

A second partition wall 52 for separating (isolating) a water flow around the second hydrofoil 22 and a water flow generated by the second propulsion unit 32 is provided between the second hydrofoil 22 and the second propulsion unit 32 (second upper propulsor 32U, second lower propulsor 32L) in the left-and-right direction. By providing the second partition wall 52, the second hydrofoil 22 is less likely to be affected by the water flow generated by the second propulsion unit 32, so that lift can be efficiently generated. In the present embodiment, the second partition wall 52 is connected to the second hydrofoil 22 and is configured to be pivotable together with the second hydrofoil 22. The second partition wall 52 may be configured to have an upper end positioned above the second upper propulsor 32U and a lower end positioned below the second lower propulsor 32L in the up-and-down direction. The second propulsion unit 32 (second upper propulsor 32U, second lower propulsor 32L) is connected to the second partition wall 52, and the second hydrofoil 22 is pivotably supported by the first support member 41 via a second extending member 52*a* extended along the pivot axis A-A of the second hydrofoil. The second extending member 52*a* is a member that connects the second hydrofoil 22 and the first support member 41, and can be disposed between the second upper propulsor 32U and the second lower propulsor 32L in the up-and-down direction. In the present embodiment, the second extending member 52*a* is formed in a plate shape, but preferably has a shape that does not affect the water flow generated by the second hydrofoil 22, and may be formed in another shape such as a cylindrical shape or a columnar shape.

In the second hydrofoil 22 having the second propulsion unit 32 described above, the elevation angle (angle ωY about the axis parallel to the left-and-right direction) may passively change according to an output difference (propulsive force difference) between the second upper propulsor 32U and the second lower propulsor 32L. As an example, by increasing the output (propulsive force) of the second lower propulsor 32L more than the output (propulsive force) of the second upper propulsor 32U, the angle ωY of the second hydrofoil 22 can be changed so as to increase the elevation angle α. In contrast, by decreasing the output (propulsive force) of the second lower propulsor 32L less than the output (propulsive force) of the second upper propulsor 32U, the angle ωY of the second hydrofoil 22 can be changed so as to decrease the elevation angle α.

As shown in FIGS. 1 and 2, the aquatic moving body 100 of the present embodiment may include a third hydrofoil 23. The third hydrofoil 23 is provided at a rear portion of the hull 10 below the hull 10 and is supported by a second support member 42 attached to a lower portion (lower surface) of the hull 10. In the present embodiment, the third hydrofoil 23 is disposed behind (on the −X direction side of) the first hydrofoil 21 and the second hydrofoil 22, and can be disposed closer to the hull 10 (on the +Z direction side) than the first hydrofoil 21 and the second hydrofoil 22. That is, the third hydrofoil 23 is provided so as to have a shorter distance to the hull 10 than the first hydrofoil 21 and the second hydrofoil 22. In addition, an angle (e.g., angle ωY about the axis parallel to the left-and-right direction) of the third hydrofoil 23 with respect to the hull 10 is fixed. Here, as shown in FIG. 2, the third hydrofoil 23 of the present embodiment is formed in a V shape when viewed from the rear side in order to reduce variation of the rear portion of the hull 10 in the left-and-right direction. However, the shape is not limited thereto, and the third hydrofoil 23 may be formed in, for example, a linear shape or a curved shape when viewed from the rear.

The first hydrofoil 21, the second hydrofoil 22, and the third hydrofoil 23 have a cross-sectional shape (airfoil shape) in which an upper surface is curved more than a lower surface. With this cross-sectional shape, the speed of fluid (water) flow becomes higher on the lower surface of each hydrofoil than on the upper surface thereof, so that the pressure on the upper surface thereof becomes smaller than the pressure on the lower surface thereof, and thus, lift for floating the hull 10 above the water surface WS can be generated in each hydrofoil. In addition, in the present embodiment, the first hydrofoil 21, the second hydrofoil 22, and the third hydrofoil 23 are disposed in water below the hull 10 so that the lift generated in the hydrofoils can be efficiently transmitted to the hull 10, but the present invention is not limited thereto. For example, the first hydrofoil 21, the second hydrofoil 22, and the third hydrofoil 23 may be disposed in water other than below the hull 10 by using the first support member 41 and/or the second support member 42 formed in an L shape. Further, in the present embodiment, one propulsor is provided on each of the upper and lower sides of each of the first hydrofoil 21 and the second hydrofoil 22, but the present invention is not limited thereto, and a plurality of propulsors may be provided on each of the upper and lower sides thereof.

Figures 5, 6:
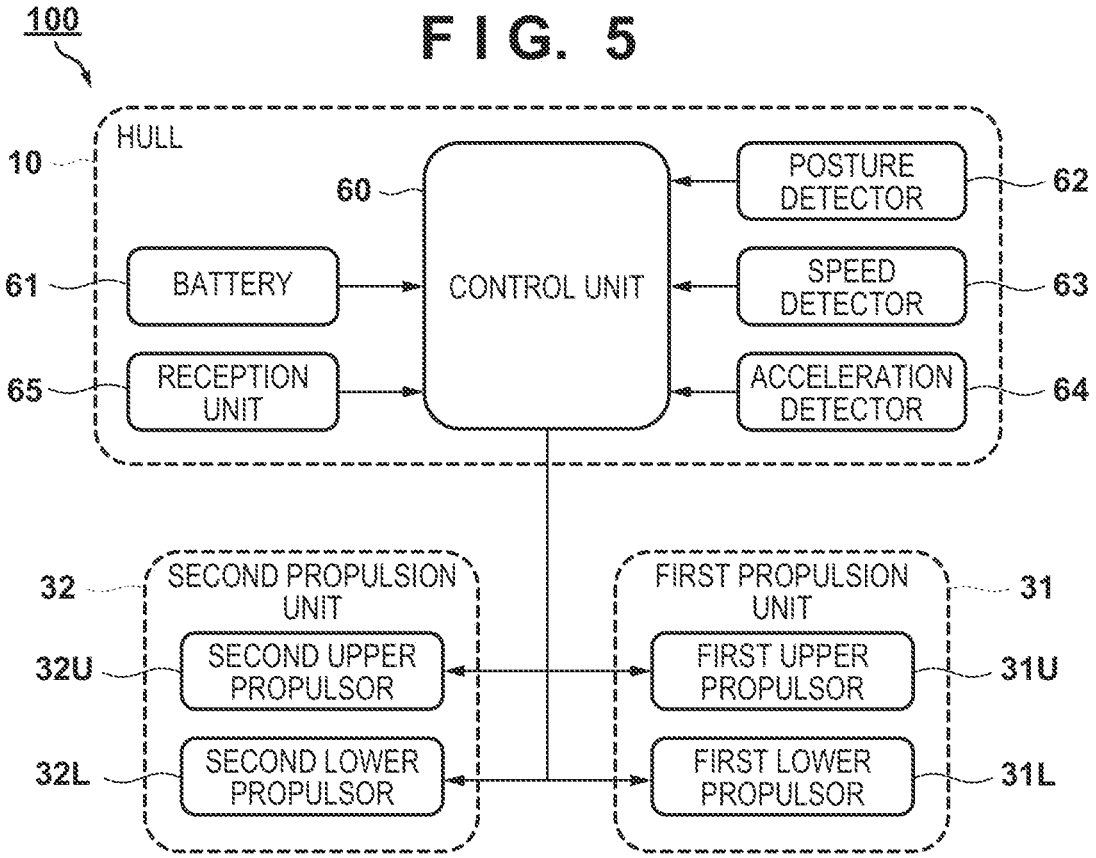
FIG. 5 is a control block diagram of the aquatic moving body.
FIG. 6 is a diagram showing an output relationship of propulsors for controlling a posture of a hull.

Next, an example of controlling the aquatic moving body 100 (ship) of the present embodiment will be described. FIG. 5 is a control block diagram of the aquatic moving body 100. As shown in FIG. 5, the aquatic moving body 100 of the present embodiment includes a control unit 60 (a controller) configured to control a posture of the hull 10 by controlling the first propulsion unit 31 and the second propulsion unit 32. Specifically, the control unit 60 individually adjusts the outputs (propulsive forces) of the first upper propulsor 31U, the first lower propulsor 31L, the second upper propulsor 32U, and the second lower propulsor 32L, to thereby individually adjust the elevation angles of the first hydrofoil 21 and the second hydrofoil 22, so that the posture of the hull 10 can be controlled. The control unit 60 is, for example, an electronic control unit (ECU), and can include a processor represented by a central processing unit (CPU), a storage device such as a semiconductor memory, an interface with an external device, and the like. The aquatic moving body 100 further includes a battery 61 that stores electric power supplied to the first propulsion unit 31 and the second propulsion unit 32. The control unit 60 can control the propulsive forces of the propulsors by controlling the electric power supplied from the battery 61 to the propulsors. The control unit 60 and the battery 61 can be mounted on the hull 10.

In addition, the aquatic moving body 100 can further include a posture detector 62 that detects a posture of the hull 10. The posture detector 62 includes, for example, a gyro sensor, and detects inclination of the hull 10 (that is, pitching, rolling, and yawing of the hull 10) with respect to each of a pitch axis, a roll axis, and a yaw axis. Based on the detection result of the posture detector 62, the control unit 60 can control the posture (pitching, rolling, and yawing) of the hull 10 so that the hull 10 maintains a target posture (e.g., horizontal). Here, as shown in FIG. 5, the aquatic moving body 100 may further include a speed detector 63 that detects a speed of the hull 10 and an acceleration detector 64 that detects an acceleration of the hull 10. This allows the control unit 60 to control the speed and acceleration of the hull 10 based on the detection results of the speed detector 63 and the acceleration detector 64. The detectors 62 to 64 can be mounted on the hull 10.

The aquatic moving body 100 may further include a reception unit 65 that receives a control instruction (input) of the aquatic moving body 100 by an operator riding on the hull 10. The control instruction can include, for example, right turning, left turning, acceleration, deceleration, and the like of the aquatic moving body 100. The reception unit 65 may be configured to receive an operation of a steering rod (steering wheel) by the operator as a control instruction, or may include a sensor that detects weight shift of the operator on the hull 10 and be configured to receive the weight shift of the operator as a control instruction. As an example, when the reception unit 65 receives a control instruction for turning the aquatic moving body 100 to the right, the control unit 60 controls the first propulsion unit 31 and the second propulsion unit 32 such that the output (propulsive force) of the second propulsion unit 32 is larger than the output (propulsive force) of the first propulsion unit 31 by an amount corresponding to the control instruction (size of right turning). This allows the aquatic moving body 100 to turn right. On the other hand, when the reception unit 65 receives a control instruction for turning the aquatic moving body 100 to the left, the control unit 60 controls the first propulsion unit 31 and the second propulsion unit 32 such that the output (propulsive force) of the first propulsion unit 31 is larger than the output (propulsive force) of the second propulsion unit 32 by an amount corresponding to the control instruction (size of left turning). This allows the aquatic moving body 100 to turn left.

Next, control of the posture of the hull 10 in the aquatic moving body 100 of the present embodiment will be described. In the aquatic moving body 100 of the present embodiment, the control unit 60 automatically controls the posture of the hull 10 so that the hull 10 maintains the target posture (e.g., horizontal) based on the detection result of the posture detector 62. Specifically, the control unit 60 individually adjusts the outputs of the first upper propulsor 31U, the first lower propulsor 31L, the second upper propulsor 32U, and the second lower propulsor 32L (that is, adjusts the output balance of the propulsors 31U, 31L, 32U, and 32L), whereby the posture of the hull 10 can be automatically controlled so that the hull 10 maintains the target posture.

Here, even when executing the control of the aquatic moving body 100 according to the control instruction by the operator, the control unit 60 can automatically control the posture of the hull 10 so that the hull 10 maintains the target posture. As an example, when receiving a control instruction for turning (turning right or turning left) the aquatic moving body 100, the control unit 60 can control the turning of the aquatic moving body 100 while controlling the hull 10 in the target posture. Similarly, even when receiving a control instruction for raising and lowering the hull 10 in the up-and-down direction by accelerating and decelerating the aquatic moving body 100, the control unit 60 can control the raising and lowering of the hull 10 while controlling the hull 10 in the target posture.

FIG. 6 shows an output relationship of the propulsors for controlling the posture of the hull 10. In FIG. 6, "F1U" represents an output of the first upper propulsor 31U, and "F1L" represents an output of the first lower propulsor 31L. In addition, "F2U" represents an output of the second upper propulsor 32U, and "F2L" represents an output of the second lower propulsor 32L. Note that the output of each propulsor is a propulsive force generated by each propulsor.

For example, when controlling rolling of the hull 10, the control unit 60 adjusts a difference between an output difference between the first upper propulsor 31U and the first lower propulsor 31L and an output difference between the second upper propulsor 32U and the second lower propulsor 32L.

Specifically, when the left side of the hull 10 is raised ("+(left up)" in FIG. 6), the control unit 60 controls the propulsors such that the output difference (F1U−F1L) between the first upper propulsor 31U and the first lower propulsor 31L is larger than the output difference (F2U−F2L) between the second upper propulsor 32U and the second lower propulsor 32L. On the other hand, when the left side of the hull 10 is lowered ("+(left down)" in FIG. 6), the control unit 60 controls the propulsors such that the output difference (F1U−F1L) between the first upper propulsor 31U and the first lower propulsor 31L is smaller than the output difference (F2U−F2L) between the second upper propulsor 32U and the second lower propulsor 32L. In the present embodiment, the example in which the rolling of the hull 10 is controlled using the output difference between the upper propulsor and the lower propulsor has been described. However, the rolling of the hull 10 may be controlled using an output ratio between the upper propulsor and the lower propulsor.

When controlling pitching of the hull 10, the control unit 60 adjusts a difference (output difference) between a resultant of the outputs of the first upper propulsor 31U and the second upper propulsor 32U and a resultant of the outputs of the first lower propulsor 31L and the second lower propulsor 32L.

Specifically, when the front side of the hull 10 is raised ("+(front up)" in FIG. 6), the control unit 60 controls the propulsors such that a resultant (F1U+F2U) of the output F1U of the first upper propulsor 31U and the output F2U of the second upper propulsor 32U is smaller than a resultant (F1L+F2L) of the output F1L of the first lower propulsor 31L and the output F2L of the second lower propulsor 32L. On the other hand, when the front side of the hull 10 is lowered ("−(front down)" in FIG. 6), the control unit 60 controls the propulsors such that the resultant (F1U+F2U) of the output F1U of the first upper propulsor 31U and the output F2U of the second upper propulsor 32U is larger than the resultant (F1L+F2L) of the output F1L of the first lower propulsor 31L and the output F2L of the second lower propulsor 32L.

When controlling yawing of the hull 10, the control unit 60 adjusts an output difference between the first propulsion unit 31 (first upper propulsor 31U, first lower propulsor 31L) and the second propulsion unit 32 (second upper propulsor 32U, second lower propulsor 32L). Specifically, when the hull 10 is rotated to the right ("+(right rotation" in FIG. 6), the control unit 60 controls the propulsors such that a resultant of the output F1U of the first upper propulsor 31U and the output F1L of the first lower propulsor 31L is smaller than a resultant of the output F2U of the second upper propulsor 32U and the output F2L of the second lower propulsor 32L. On the other hand, when the hull 10 is rotated to the left ("+(left rotation" in FIG. 6), the control unit 60 controls the propulsors such that the resultant of the output F1U of the first upper propulsor 31U and the output F1L of the first lower propulsor 31L is larger than the resultant of the output F2U of the second upper propulsor 32U and the output F2L of the second lower propulsor 32L.

In the aquatic moving body 100 of the present embodiment, lift of the first hydrofoil 21 and the second hydrofoil 22 can be increased by increasing the elevation angles of the first hydrofoil 21 and the second hydrofoil 22 disposed on the front side of the hull 10. In this case, an elevation angle of the third hydrofoil 23 disposed on the rear side of the hull 10 also increases following transition of the hull 10 to a posture rising forward in the pitch direction, and lift of the third hydrofoil 23 increases so as to cancel the transition to the posture rising forward in the pitch direction. That is, in the configuration of the aquatic moving body 100 of the present embodiment, the hull 10 can be raised and lowered in the up-and-down direction while maintaining the target posture. In addition, since the third hydrofoil 23 is closer in distance to the hull 10 than the first hydrofoil 21 and the second hydrofoil 22, when the hull 10 is attempted to be further floated, the third hydrofoil 23 comes out of the water surface WS before the first hydrofoil 21 and the second hydrofoil 22. In this case, the third hydrofoil 23 no longer moves up, so that it is assumed that only the first hydrofoil 21 and the second hydrofoil 22 are raised and the hull 10 thus takes the posture rising forward. However, in the aquatic moving body 100 of the present embodiment, the control unit 60 controls the posture of the hull 10 so that the hull 10 maintains the target posture based on the detection result of the posture detector 62. For this reason, when the hull 10 takes the posture rising forward, the propulsors are controlled so as to reduce the lift of the first hydrofoil 21 and the second hydrofoil 22. Therefore, the aquatic moving body 100 can control a floating height of the hull 10 from the water surface WS such that the hydrofoils are positioned in water. In this manner, according to the configuration of the aquatic moving body 100 of the present embodiment, the floating height of the hull 10 can be controlled only by the detection result of the posture of the hull 10 without directly detecting the floating height of the hull 10.

As described above, the aquatic moving body 100 of the present embodiment includes the first hydrofoil 21 and the second hydrofoil 22 arranged along the left-and-right direction below the hull 10, the first propulsion unit 31 (first upper propulsor 31U, first lower propulsor 31L) is provided at the end portion of the first hydrofoil 21, and the second propulsion unit 32 (second upper propulsor 32U, second lower propulsor 32L) is provided at the end portion of the second hydrofoil 22. The first hydrofoil 21 and the second hydrofoil are then configured such that the elevation angles thereof change according to the outputs of the propulsors. With this configuration, the posture (rolling, pitching, yawing) of the hull 10 can be accurately controlled by adjusting the outputs of the propulsors. In addition, the aquatic moving body 100 of the present embodiment includes the first partition wall 51 between the first hydrofoil 21 and the first propulsion unit 31, and the second partition wall 52 between the second hydrofoil 22 and the second propulsion unit 32. As a result, the effect of the water flow generated by the first propulsion unit 31 on the first hydrofoil 21 can be reduced by the first partition wall 51, and similarly, the effect of the water flow generated by the second propulsion unit 32 on the second hydrofoil 22 can be reduced by the second partition wall 52. Therefore, it is possible to efficiently generate lift in the first hydrofoil 21 and the second hydrofoil 22.

Second Embodiment

Figure 7:
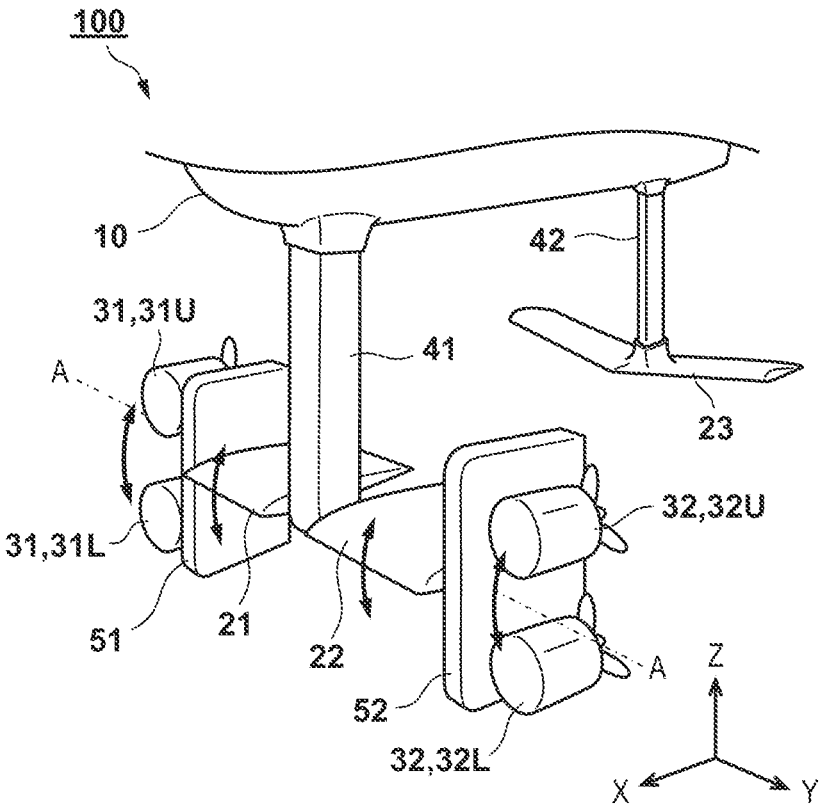
FIG. 7 is a diagram of the aquatic moving body according to a second embodiment as viewed obliquely from the front.
Figure 8:
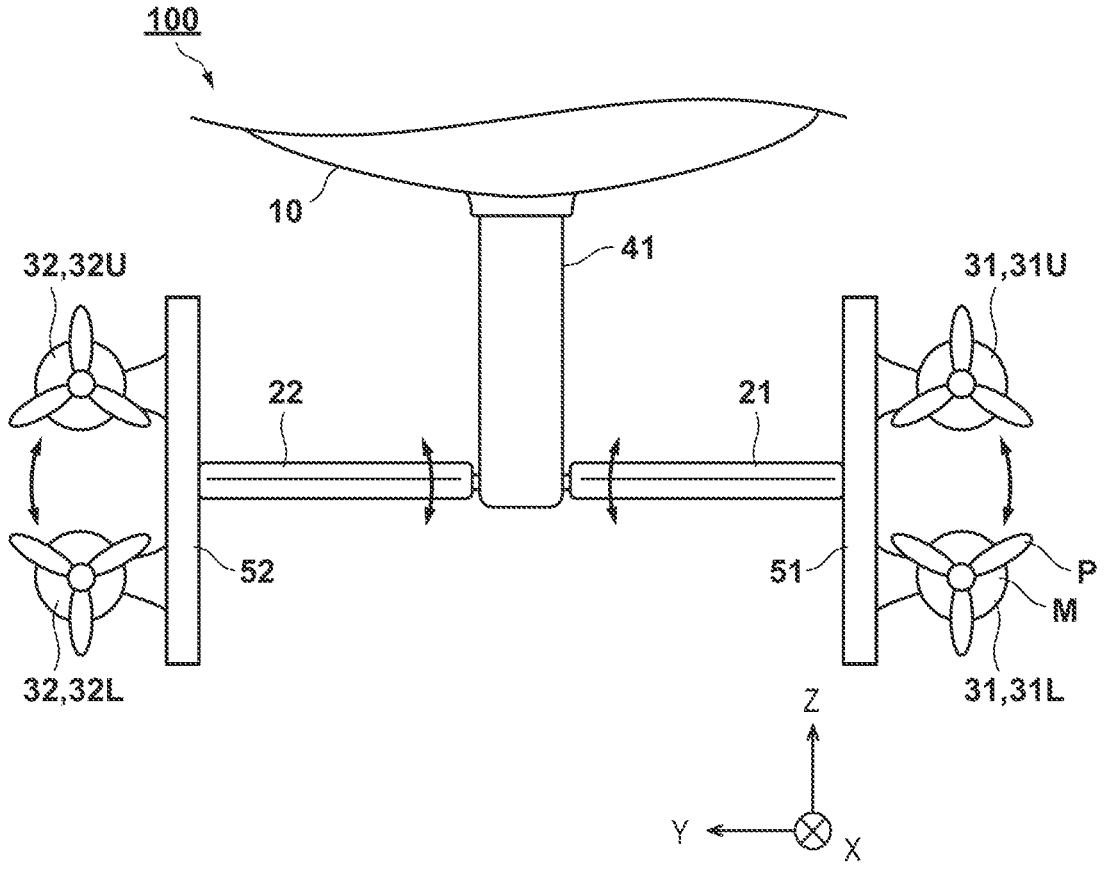
FIG. 8 is a rear view of a first hydrofoil and a second hydrofoil, and a peripheral configuration thereof in the aquatic moving body according to the second embodiment.

Hereinafter, a aquatic moving body 100 of a second embodiment according to the present invention will be described. The second embodiment basically follows the first embodiment, and the configuration and arrangement of a first propulsion unit 31 and a second propulsion unit 32 are different from those of the first embodiment, but the other configurations and processes are as described in the first embodiment. Therefore, hereinafter, configurations and arrangements of the first propulsion unit 31 and the second propulsion unit 32, which are different from those of the first embodiment, will be described with reference to FIGS. 7 to 8. FIG. 7 is a diagram showing the aquatic moving body 100 according to the second embodiment as viewed obliquely from the front and the upper side of a hull 10 is omitted. FIG. 8 is a rear view of a first hydrofoil 21 and a second hydrofoil 22, and a peripheral configuration thereof according to the second embodiment.

In the aquatic moving body 100 of the present embodiment, the first propulsion unit 31 is disposed on an outer side of the first hydrofoil 21 (−Y direction side), that is, at an end portion of the first hydrofoil 21 on a side opposite to the second hydrofoil 22 in the left-and-right direction. It may be understood that the first hydrofoil 21 is disposed between the first propulsion unit 31 and a first support member 41. In addition, the first propulsion unit 31 may include a first upper propulsor 31U disposed above the first hydrofoil 21 in the up-and-down direction and a first lower propulsor 31L disposed below the first hydrofoil 21 in the up-and-down direction. A first partition wall 51 for separating (isolating) a water flow around the first hydrofoil 21 and a water flow generated by the first propulsion unit 31 is provided between the first hydrofoil 21 and the first propulsion unit 31 (first upper propulsor 31U, first lower propulsor 31L) in the left-and-right direction. Here, the first extending member 51*a* described in the first embodiment may be provided between the first upper propulsor 31U and the first lower propulsor 31L in order to separate a water flow generated by the first upper propulsor 31U and a water flow generated by the first lower propulsor 31L to prevent the water flows from affecting each other.

Similarly, the second propulsion unit 32 is disposed on an outer side of the second hydrofoil 22 (+Y direction side) in the left-and-right direction, that is, at an end portion of the second hydrofoil 22 on a side opposite to the first hydrofoil 21 in the left-and-right direction. It may be understood that the second hydrofoil 22 is disposed between the second propulsion unit 32 and the first support member 41. In addition, the second propulsion unit 32 may include a second upper propulsor 32U disposed above the second hydrofoil 22 in the up-and-down direction and a second lower propulsor 32L disposed below the second hydrofoil 22 in the up-and-down direction. A second partition wall 52 for separating (isolating) a water flow around the second hydrofoil 22 from a water flow generated by the second propulsion unit 32 is provided between the second hydrofoil 22 and the second propulsion unit 32 (second upper propulsor 32U, second lower propulsor 32L) in the left-and-right direction. Here, the second extending member 52*a* described in the first embodiment may be provided between the second upper propulsor 32U and the second lower propulsor 32L in order to separate a water flow generated by the second upper propulsor 32U and a water flow generated by the second lower propulsor 32L to prevent the water flows from affecting each other.

Also, with the configuration of the present embodiment, the effect of the water flow generated by the first propulsion unit 31 on the first hydrofoil 21 can be reduced by the first partition wall 51, and similarly, the effect of the water flow generated by the second propulsion unit 32 on the second hydrofoil 22 can be reduced by the second partition wall 52. Therefore, it is possible to efficiently generate lift in the first hydrofoil 21 and the second hydrofoil 22. Here, comparing the configuration of the first embodiment (FIGS. 2 to 3) with the configuration of the second embodiment (FIGS. 7 to 8), the configuration of the first embodiment is advantageous from the viewpoint of the support structure (support strength) of the propulsion units 31 and 32 which are heavy objects, and the configuration of the second embodiment is advantageous from the viewpoint of controllability (operability and responsiveness) of the posture of the hull 10 such as yawing. Note that the configuration of the aquatic moving body 100 is not limited to the above two embodiments, and the positional relationship between the hydrofoil and the propulsor can be properly and appropriately changed according to the properties of the hull 10, the performance and weight of the propulsor, and the like.

Other Embodiments

In the above embodiment, an electric propulsor having a motor M is used as the propulsors constituting the first propulsion unit 31 and the second propulsion unit 32, but the present invention is not limited thereto, and an engine propulsor may be used. In this case, engines may be individually provided in the propulsors, but one engine may be mounted on the hull 10 so that a driving force of the engine is transmitted to propellers P of the propulsors by a transmission mechanism or the like.

Summary of Embodiments

1. The aquatic moving body of the above embodiment is an aquatic moving body (e.g., 100) configured to move in a state where a main body portion (e.g., 10) is floated above a water surface, including:

a first hydrofoil (e.g., 21) and a second hydrofoil (e.g., 22) disposed along a left-and-right direction of the aquatic moving body and provided in the main body portion so as to be able to change elevation angles independently of each other;

a first propulsion unit (e.g., 31) provided at an end portion of the first hydrofoil and configured to generate a propulsive force; and a second propulsion unit (e.g., 32) provided at an end portion of the second hydrofoil and configured to generate a propulsive force, in which a first partition wall (e.g., 51) for separating a water flow around the first hydrofoil and a water flow generated by the first propulsion unit is provided between the first hydrofoil and the first propulsion unit, and a second partition wall (e.g., 52) for separating a water flow around the second hydrofoil and a water flow generated by the second propulsion unit is provided between the second hydrofoil and the second propulsion unit.

According to this configuration, the posture of the main body portion can be controlled by individually adjusting the outputs of the propulsion units to individually change the elevation angles of the first hydrofoil and second hydrofoil. In addition, since the effects of the water flows generated by the propulsion units on the hydrofoils can be reduced by the partition walls, lift can be efficiently generated in the hydrofoils.

2. In the above embodiment, the first propulsion unit is attached to the first partition wall, and the second propulsion unit is attached to the second partition wall.

According to this configuration, the effects of the water flows generated by the propulsion units on the hydrofoils can be more effectively reduced by the partition walls.

3. In the above embodiment, the first propulsion unit is provided at an end portion of the first hydrofoil on a side of the second hydrofoil, and the second propulsion unit is provided at an end portion of the second hydrofoil on a side of the first hydrofoil.

This configuration is advantageous from the viewpoint of the support structure (support strength) of the propulsion units that are heavy objects.

4. In the above embodiment, the first propulsion unit is provided at an end portion of the first hydrofoil on a side opposite to the second hydrofoil, and the second propulsion unit is provided at an end portion of the second hydrofoil on a side opposite to the first hydrofoil.

This configuration is advantageous from the viewpoint of controllability (responsiveness) of the posture of the hull 10 such as yawing.

5. In the above embodiment, a support member (e.g., 41) attached to a lower portion of the main body portion and configured to pivotably support the first hydrofoil and the second hydrofoil is further included, and the first hydrofoil and the second hydrofoil are disposed so as to sandwich the support member in the left-and-right direction.

This configuration is advantageous in terms of the support structure (support strength) of the first hydrofoil and the second hydrofoil and reduction of water resistance.

6. In the above embodiment, the first propulsion unit includes: a first upper propulsor (e.g., 31U) disposed above the first hydrofoil in an up-and-down direction of the aquatic moving body; and a first lower propulsor (e.g., 31L) disposed below the first hydrofoil in the up-and-down direction, and the second propulsion unit includes: a second upper propulsor (e.g., 32U) disposed above the second hydrofoil in the up-and-down direction; and a second lower propulsor (e.g., 32L) disposed below the second hydrofoil in the up-and-down direction.

According to this configuration, the posture of the main body portion (e.g., rolling, pitching, and yawing) can be accurately controlled by individually adjusting the outputs of the propulsors to individually change the elevation angles of the first hydrofoil and second hydrofoil. As a result, it is possible to reduce variation of the posture and swinging of the main body portion.

7. In the above embodiment, the first hydrofoil is configured such that an elevation angle changes according to an output difference between the first upper propulsor and the first lower propulsor, and the second hydrofoil is configured such that an elevation angle changes according to an output difference between the second upper propulsor and the second lower propulsor.

According to this configuration, the posture of the main body portion can be accurately controlled by individually adjusting the outputs (propulsive force) of the propulsors at the upper portion and lower portion for each of the first hydrofoil and second hydrofoil to individually change the elevation angles of the first hydrofoil and second hydrofoil.

8. In the above embodiment, a controller (e.g., 50) configured to control a posture of the main body portion by adjusting output balance of the first upper propulsor, the first lower propulsor, the second upper propulsor, and the second lower propulsor is further included.

According to this configuration, the posture of the main body portion can be accurately controlled by individually adjusting the outputs of the propulsors.

9. In the above embodiment, the controller is configured to control rolling of the main body portion by adjusting a difference between an output difference between the first upper propulsor and the first lower propulsor and an output difference between the second upper propulsor and the second lower propulsor.

According to this configuration, the rolling can be controlled as the posture of the main body portion by adjusting the outputs of the propulsors.

10. In the above embodiment, the controller is configured to control pitching of the main body portion by adjusting a difference between a resultant of outputs of the first upper propulsor and the second upper propulsor and a resultant of outputs of the first lower propulsor and the second lower propulsor.

According to this configuration, the pitching can be controlled as the posture of the main body portion by adjusting the outputs of the propulsors.

11. In the above embodiment, the controller is configured to control yawing of the main body portion by adjusting an output difference between the first propulsion unit and the second propulsion unit.

According to this configuration, the yawing can be controlled as the posture of the main body portion by adjusting the outputs of the propulsors.

12. In the above embodiment, a third hydrofoil (e.g., 23) fixed to the main body portion behind the first hydrofoil and the second hydrofoil is further included. According to this configuration, the posture of the main body portion floating above the water surface can be further stabilized.

13. In the above embodiment, the aquatic moving body is a ship configured to move in a state where a hull as the main body portion is floated above a water surface.

According to this configuration, in the ship configured to move in the state where the hull is floated above the water surface, it is possible to reduce the variation of the posture and swinging of the hull.

The invention is not limited to the foregoing embodiments, and various variations/changes are possible within the spirit of the invention.

What is claimed is:

1. An aquatic moving body configured to move in a state where a main body portion is floated above a water surface, comprising:

a first hydrofoil and a second hydrofoil disposed along a left-and-right direction of the aquatic moving body and provided in the main body portion so as to be able to change elevation angles independently of each other;

a first propulsion unit provided at an end portion of the first hydrofoil and configured to generate a propulsive force; and a second propulsion unit provided at an end portion of the second hydrofoil and configured to generate a propulsive force, wherein a first partition wall for separating a water flow around the first hydrofoil and a water flow generated by the first propulsion unit is provided between the first hydrofoil and the first propulsion unit, and wherein a second partition wall for separating a water flow around the second hydrofoil and a water flow generated by the second propulsion unit is provided between the second hydrofoil and the second propulsion unit.

2. The aquatic moving body according to claim 1, wherein the first propulsion unit is attached to the first partition wall, and the second propulsion unit is attached to the second partition wall.

3. The aquatic moving body according to claim 1, wherein the first propulsion unit is provided at an end portion of the first hydrofoil on a side of the second hydrofoil, and the second propulsion unit is provided at an end portion of the second hydrofoil on a side of the first hydrofoil.

4. The aquatic moving body according to claim 1, wherein the first propulsion unit is provided at an end portion of the first hydrofoil on a side opposite to the second hydrofoil, and the second propulsion unit is provided at an end portion of the second hydrofoil on a side opposite to the first hydrofoil.

5. The aquatic moving body according to claim 1, further comprising a support member attached to a lower portion of the main body portion and configured to pivotably support the first hydrofoil and the second hydrofoil, wherein the first hydrofoil and the second hydrofoil are disposed so as to sandwich the support member in the left-and-right direction.

6. The aquatic moving body according to claim 1, wherein the first propulsion unit includes: a first upper propulsor disposed above the first hydrofoil in an up-and-down direction of the aquatic moving body; and a first lower propulsor disposed below the first hydrofoil in the up-and-down direction, and the second propulsion unit includes: a second upper propulsor disposed above the second hydrofoil in the up-and-down direction; and a second lower propulsor disposed below the second hydrofoil in the up-and-down direction.

7. The aquatic moving body according to claim 6, wherein the first hydrofoil is configured such that an elevation angle changes according to an output difference between the first upper propulsor and the first lower propulsor, and the second hydrofoil is configured such that an elevation angle changes according to an output difference between the second upper propulsor and the second lower propulsor.

8. The aquatic moving body according to claim 6, further comprising a controller configured to control a posture of the main body portion by adjusting output balance of the first upper propulsor, the first lower propulsor, the second upper propulsor, and the second lower propulsor.

9. The aquatic moving body according to claim 8, wherein the controller is configured to control rolling of the main body portion by adjusting a difference between an output difference between the first upper propulsor and the first lower propulsor and an output difference between the second upper propulsor and the second lower propulsor.

10. The aquatic moving body according to claim 8, wherein the controller is configured to control pitching of the main body portion by adjusting a difference between a resultant of outputs of the first upper propulsor and the second upper propulsor and a resultant of outputs of the first lower propulsor and the second lower propulsor.

11. The aquatic moving body according to claim 8, wherein the controller is configured to control yawing of the main body portion by adjusting an output difference between the first propulsion unit and the second propulsion unit.

12. The aquatic moving body according to claim 1, further comprising a third hydrofoil fixed to the main body portion behind the first hydrofoil and the second hydrofoil.

13. The aquatic moving body according to claim 1, wherein the aquatic moving body is a ship configured to move in a state where a hull as the main body portion is floated above a water surface.

* * * * *